US006154996A

United States Patent [19]

Andreassen

[11] Patent Number: 6,154,996

[45] Date of Patent: Dec. 5, 2000

[54] LOCKING DEVICE FOR FIREARMS

[75] Inventor: Øyvind Andreassen, Moss, Norway

[73] Assignee: TrioVing AS, Norway

[21] Appl. No.: 09/125,257

[22] PCT Filed: Feb. 12, 1997

[86] PCT No.: PCT/NO97/00040

§ 371 Date: Jan. 12, 1999

§ 102(e) Date: Jan. 12, 1999

[87] PCT Pub. No.: WO97/29338

PCT Pub. Date: Aug. 14, 1997

[30] Foreign Application Priority Data

Feb. 12, 1996 [NO] Norway ..... 960546

[51] Int. Cl.[7] ..... F41A 17/00

[52] U.S. Cl. ..... 42/70.11

[58] Field of Search ..... 42/70, 70.11, 70.5

[56] References Cited

U.S. PATENT DOCUMENTS

| | | | |
|---|---|---|---|
| 4,384,420 | 5/1983 | Von Muller | 42/1 |
| 4,398,366 | 8/1983 | Wernicki | 42/1 |
| 4,672,762 | 6/1987 | Nilsson | 42/70.11 |
| 4,827,649 | 5/1989 | Sheehan | 42/70.11 |
| 5,054,223 | 10/1991 | Lee | 42/70.11 |
| 5,138,785 | 8/1992 | Paterson | 42/70.11 |
| 5,465,519 | 11/1995 | Blanck | 42/70.11 |
| 5,659,993 | 8/1997 | Watson, Jr. et al. | 42/70.05 |

FOREIGN PATENT DOCUMENTS

90/04148 4/1990 WIPO .

*Primary Examiner*—Charles T. Jordan
*Assistant Examiner*—Denise J. Buckley
*Attorney, Agent, or Firm*—Bierman, Muserlian and Lucas

[57] ABSTRACT

A locking device for locking into the bolt cavity of a firearm for making it non-functional, comprises a housing (1) which contains a lock cylinder (3) operable by means of a key which is introducible through a drilling protection (4) in the housing. The cylinder arm (8) of the lock cylinder (3) is non-rotatably connected to a follower (7), which has a flattening (9) which upon rotation of the follower pushes a wedge member (15) in the form of a steel ball between two blocking members (14), also in the form of steel balls, so that they are brought to extend partly from opposite sides of the housing (1). The locking device may be introduced into the magazine well of the firearm and located such that the extending blocking elements (14) will cooperate with e.g. the locking piece or receiver rails of the firearm in order to prevent the extraction of the locking device in its locked condition.

8 Claims, 2 Drawing Sheets

Figure 6:
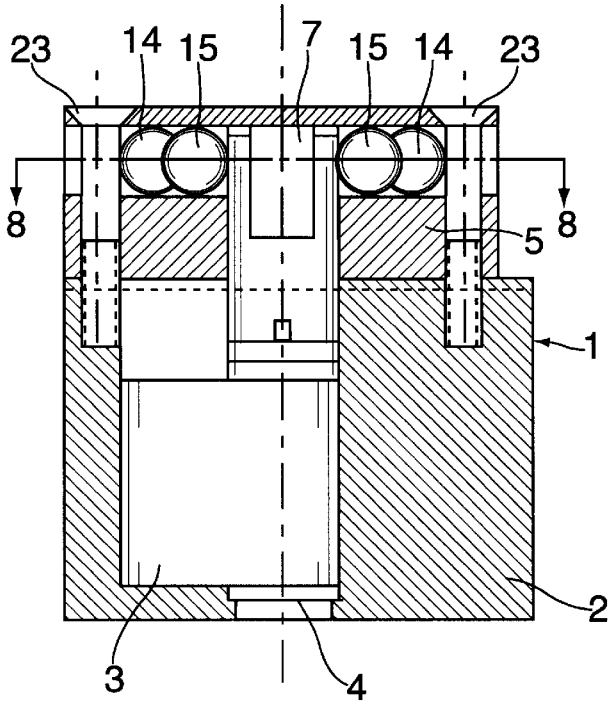

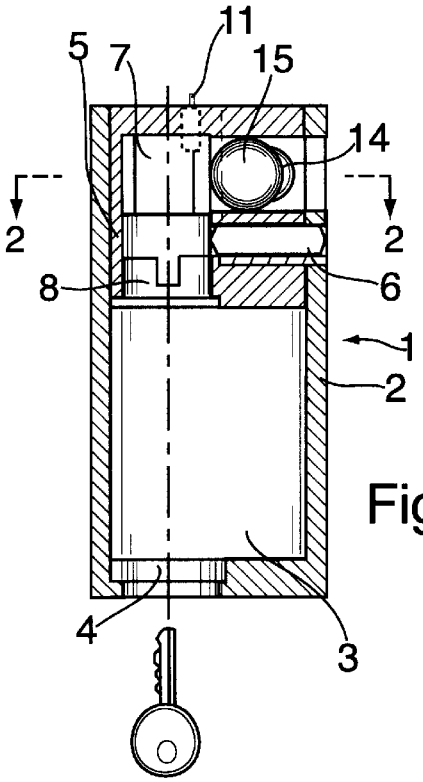
Fig. 1
Fig. 2
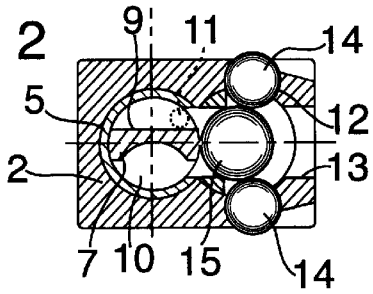
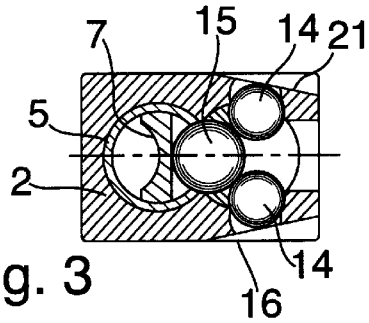
Fig. 3
Fig. 4
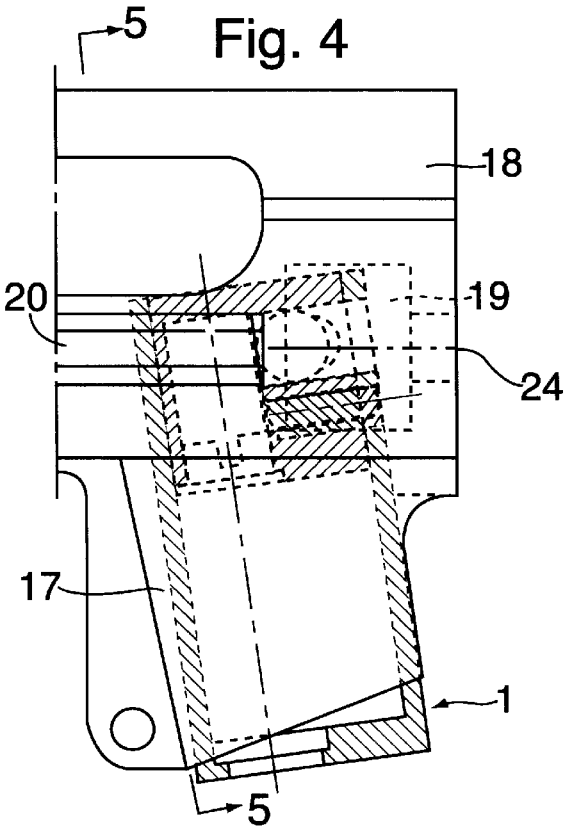
Fig. 5
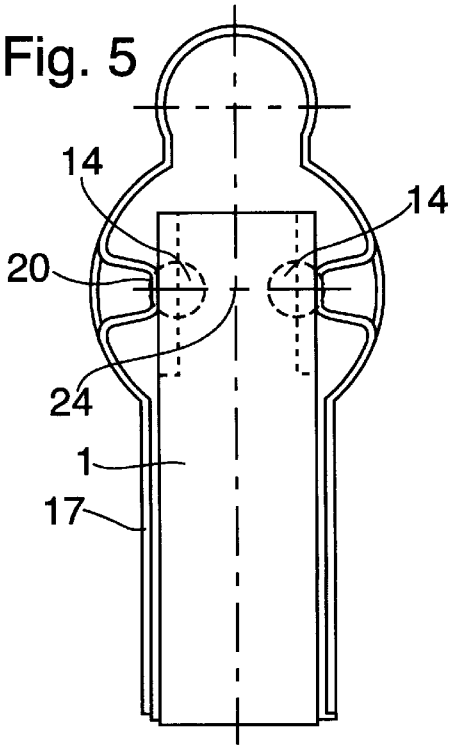

LOCKING DEVICE FOR FIREARMS

The present invention relates to a locking device to be locked in the bolt cavity of a firearm in order to make it non-functional, comprising a housing which contains a lock cylinder which is operable by means of a key which is introducible through an opening in the housing, said lock cylinder at its inner end being provided with a follower, said housing further containing two locking members, each in the form of at least one steel ball, which are received movably in a guide in the housing extending transversally of the longitudinal direction of the firearm, to be moved between a position in which they are withdrawn into the housing and a position in which they extend partly from either side of the housing, said housing also having a wedge member, which by means of said follower is movable in a direction transversally of said guide and which by pivoting of the follower in the locking direction pushes said blocking members to the extending position.

Such a locking device is known for instance from SE-B-433 980. In this case the housing containing the lock cylinder is provided with a cylindrical portion to be introduced into the breech of the firearm through the casing ejection port of the firearm, a fact that limits the dimensions and strength of the locking device. The part of the housing of the device containing the locking cylinder will furthermore be accessible through the casing ejection port, e.g. for attacks by means of a burglary tool or the like. In addition, the device is intended primarily for firearms having a Mauser mechanism and is not particularly suited for the typical breech design of present-day military weapons. Finally, the wedge member of the locking device according to SE-B-433 980 has a rather complex shape, as has its track, necessitating considerable manufacturing costs. The wedge member has to be positively pulled by the lock cylinder follower from the locking position, and if e.g. attempts have been made to forcibly remove the locking device from the firearm, the wedge member may be jammed so that the key of the lock may not be able to transmit a sufficient force to open the locking device without breaking.

The purpose of the present invention is to provide a locking device of the type mentioned in the introductory paragraph, the locking device providing high security against unauthorized removal from the firearm and, in addition, being well suited for use in military firearms.

This is obtained according to the invention in that the wedge member comprises a steel ball.

The fact that both the wedge member and the blocking members are steel balls, preferably ball bearing balls, with their smooth and hard surface, high strength, low cost and small production tolerances, will facilitate a simple, inexpensive, robust, easy to assemble, reliable and functional locking device. There is no possibility of the spherical wedge member getting jammed in locking position, and the only force required for operating the key for unlocking the device is essentially that of rotating the lock cylinder and its follower. As soon as the follower has been brought into the open position, the blocking members will push the wedge member back as required to release the locking device from the firearm.

Further advantageous features of the present invention are characterized in that it can have one or more of the following features:

the follower, which has a general cyclindrical form, has a flattening for cooperating with the wedge member upon rotation of the follower;

the follower, on the opposite side with respect to the flattening, has a longitudinal groove, preferably with a semicircular cross-section which has a larger depth than the flattening;

a pin, screw or the like limits the rotation of the follower so that its longitudinal groove cannot be brought to face the wedge member;

it has two pairs of blocking members, each having a separate wedge member acted upon a common follower; or its housing is shaped to fit into a magazine well in the firearm.

Figure 7:
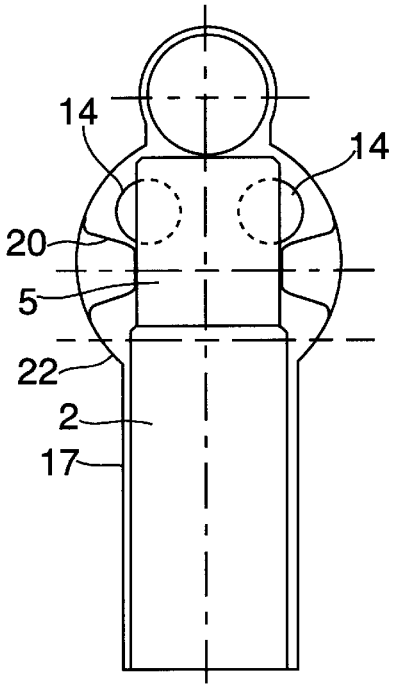
Figure 8:
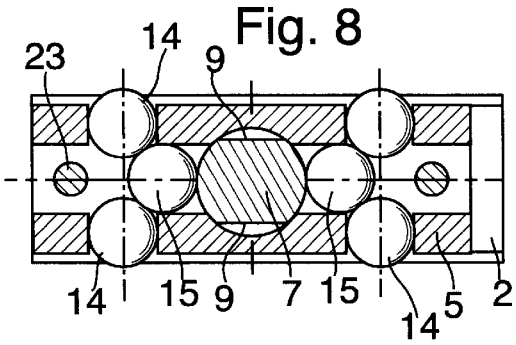
Figure 9:
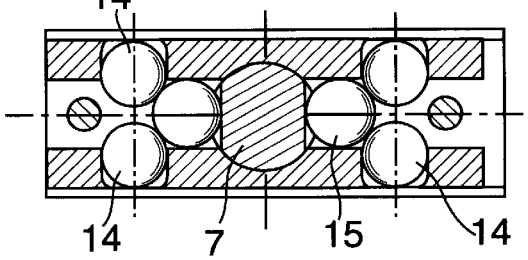

For better understanding of the invention it will be described more closely with reference to the exemplifying embodiments shown, in part schematically, in the appended drawings, wherein:

FIG. 1 is a side view, partly in section, of a locking device according to the invention in the locked position, FIG. 2 is a section along the line II—II in FIG. 1, FIG. 3 is a section similar to FIG. 2, but shows the locking device in the unlocked position, FIG. 4 is a side view of a portion of a firearm having the locking device in FIG. 1 installed, FIG. 5 is a simplified section along the line V—V in FIG. 4, FIG. 6 is a side view, partly in section, through a second embodiment of the locking device according to the invention, FIG. 7 is a simplified section similar to FIG. 5 and shows the locking device in FIG. 6 installed in the magazine well of a firearm, FIG. 8 is a section along the line VIII—VIII in FIG. 6, i.e. with the locking device in the locked position, FIG. 9 is a section similar to FIG. 8, but with the locking device in the unlocked position, The locking device illustrated in FIGS. 1–5 comprises a housing generally designated by 1, which further comprises a block 2 of hardened steel. The block 2 contains a lock cylinder 3, which is operable by means of a key, not shown, which is introducible through an opening in the block provided with a hardened drilling protection 4. The cavity of the lock cylinder 3 is formed by two parallel, partly overlapping bores, such that the cross sectional contour of the cavity becomes almost like a figure eight. Above the lock cylinder 3 in the cavity of the block a cover 5 is inserted, the cover being held in place by a hardened pin 6 driven into a pre-drilled hole in the block 2 and cover 5.

The cover 5 has a bore which rotatably receives a follower 7, which is non-rotatably connected to the cylinder arm 8 of the lock cylinder. As best seen from FIG. 2, the follower 7 has a flattening 9 and a longitudinal groove 10 opposite to the flattening, said groove having a larger radial depth than the flattening 9. A pin or screw 11 is placed into the rotational space of the follower through the cover 5 in order to limit the rotational angle of the follower to approximately 90°.

Present in the block 2 and cover 5 are two crossing bores 12 and 13. The bore 12 forms a guide for two blocking members 14 in the form of ball bearing balls. The other bore 13 receives a wedge member 15, also in the form of a ball bearing ball. The wedge member 15 is acted upon by the follower 7 and may abut against its flattening 9, as shown in FIG. 3. The locking device will then be in the unlocked position so that the blocking members 14 can assume a withdrawn position in the guide 12. By turning the key and thereby the follower 7 to the locked position, as shown in FIG. 2, the flattening 9 of the follower will push the wedge ball 15 to the right so that the blocking balls 14 are pushed to their extending position, where they will be blocked by the ball 15. The blocking balls 14 are prevented from falling out of the guide 12 because the outer openings of the guide are provided with an inwardly extending edge deformation 16, as best may be seen from FIG. 3.

When producing the locking device, the balls 14 and 15 must be positioned after the cover 5 has been installed in the block 2. In order to do this, the follower 7, before the pin 11 is installed, is pivoted so that its deeper groove 10 faces the opening of the bore 13, i.e. 180° with respect to the position shown in FIG. 3. Next, the wedge ball 15 is introduced through the bore 13 and into the groove 10. The wedge ball 15 will therefore be positioned so deeply that the blocking balls 14 may be introduced via the opening of the bore 13 into their guide 12, whereupon the follower 7 is pivoted to the position shown in FIG. 2 before the installation of the pivot restricting pin or screw 11.

As shown in FIGS. 4 and 5, the locking device in this exemplifying embodiment is intended for the introduction into the magazine well 17 of a submachine gun 18 in such a manner that its upper part extends into the bolt cavity of the firearm. In the locked position of the locking device the blocking balls 14 extend into the locking piece 19 of the firearm in front of the receiver rails 20, as schematically suggested in FIGS. 4 and 5. In order to permit the introduction of the locking device into the firearm in this manner, the block 2 is at the top provided with a tapering 21 (FIG. 3). The barrel has a center line 24 which is shown in FIGS. 4 and 5.

In the exemplifying embodiment in FIGS. 6–9, like or corresponding parts are given the same reference numerals as in the preceding examples. The block 2 shown in FIG. 6 has a larger horizontal dimension in order to fill the magazine well 17 of a military rifle 22, which will have a larger cartridge length than the submachine gun in the preceding example. The cover 5 is attached to the block 2 by means of screws 23, preferably having one-way slots in order to prevent them from being unscrewed after installation.

This locking device has two pairs of blocking balls 14, one on either side of the follower 7, which has diametrally opposed flattenings 9, each serving a separate wedge ball 15. In this example there is enough space to make the blocking balls 14 and the wedge balls 15 of the same size, a fact that simplifies the manufacture of the locking device. In this case the balls are brought in place in the cover 5 before the follower 7 is installed.

As will be apparent from FIG. 7, the blocking balls 14 lock against the top side of the receiver rails 20 of the firearm. Alternatively, it may be envisioned that e.g. the right side set of balls 14, 15 is situated at a lower level than the left side set of balls, thus making the right side set of balls lock in front of the receiver rails, similar to the first example described.

It will be seen that when an attempt is made to pull the locking device out of the firearm upon unlocking it, the blocking members, due to their rounded form, will automatically be forced into their respective guides, concurrently with the wedge member 15 being pushed back, without any fixed connection between these members or other means for moving them being present. This not only simplifies the design, but also minimizes the possibility for the locking device being jammed in the firearm in the unlocked position.

It will be understood that the invention is not limited to the exemplifying embodiments described above, but that it may be varied and modified in a number of ways within the scope of the following claims. Thus, the housing does not need to have a generally parallel-epipedic form, but may have a forwardly extending portion at the top to be introduced into the locking piece or cartridge chamber of the firearm. Furthermore, the wedge members may each consist of several parts, e.g. two or more balls, if the dimensions of the locking device should so indicate. Hardened steel will be a natural choice of materials for the exposed parts of the locking device, but it will be understood that variations are also possible in this respect. If reduced weight is important, the housing may be cast in titanium in accordance with the so-called "lost wax" method, and this method may also be used for casting stellite, which will provide a sufficiently hard product to make any subsequent heat treatment unnecessary. Sintering of a sufficiently hard material may also be an alternative in some cases. The drawings suggest a lock cylinder of the pin tumbler type, but also cylinders of the rotary disc tumbler type may be used.

What is claimed is:

1. A locking device to be locked in the bolt cavity of a firearm (18,22) in order to make the firearm nonfunctional, comprising a housing (1) which contains a lock cylinder (3) which is operable by means of a key which is introducible through an opening in the housing (1), said lock cylinder (3) having an outer end for introducing said key and an inner end which is provided with a follower (7), said housing (1) further containing two blocking members (14) each in the form of at least one steel ball, movable in a guide (12) in the housing extending transversally of the longitudinal direction of the firearm (18,22), to be moved between a position in which they are withdrawn into the housing (1) and a position in which they extend partly from either side of the housing, said housing (1) also having a wedge member (15) in the form of at least one steel ball, which by means of said follower (7) in the locking direction pushes said blocking members (14) to the extending position.

2. A locking device according to claim 1, wherein the follower (7), which has a generally cylindrical form, has a flattening (9) for cooperating with the wedge member (15) upon rotation of the follower.

3. A locking device according to claim 2, wherein the follower (7), on the opposite side with respect to the flattening (9), has a longitudinal groove (10).

4. A locking device according to claim 3, further comprising a pin, screw (11) or the like which limits the rotation of the follower (7) so that its longitudinal groove (10) cannot be brought to face the wedge member (15).

5. A locking device according to claim 1, further comprising two pairs of blocking members (14), each having a separate wedge member (15) acted upon by a common follower (7).

6. A locking device according to claim 1, wherein the housing (1) is shaped to fit into a magazine well (17) in said firearm (18,22).

7. A locking device according to claim 2, characterized in that it comprises two pairs of blocking members (14), each having a separate wedge member (15) acted upon by a common follower (7).

8. A locking device according to claim 3, wherein said longitudinal groove (10) has a semi-circular cross-section, which has a larger depth than the flattening (9).

* * * * *